US007427039B1

(12) United States Patent
Jou

(10) Patent No.: US 7,427,039 B1
(45) Date of Patent: Sep. 23, 2008

(54) SIPHON DRYING GUN

(76) Inventor: Wuu-Cheau Jou, No. 497-6, Tsao Hoo Rd., Tali, Taichung Hsien (TW)

( * ) Notice: Subject to any disclaimer, the term of this patent is extended or adjusted under 35 U.S.C. 154(b) by 62 days.

(21) Appl. No.: 11/690,366

(22) Filed: Mar. 23, 2007

(51) Int. Cl.
*E03C 1/08* (2006.01)

(52) U.S. Cl. ..... 239/428.5; 239/433; 239/434.5; 239/423; 239/526; 34/523; 34/241

(58) Field of Classification Search ..... 239/419.5, 239/423, 424, 425.5, 426, 428.5, 433–434.5, 239/526; 34/96–98, 201, 235, 241, 523
See application file for complete search history.

(56) References Cited

U.S. PATENT DOCUMENTS 2,965,312 A * 12/1960 Hale ..... 239/416.5
3,587,974 A * 6/1971 Rozenkranz ..... 239/423
3,743,186 A * 7/1973 Mocarski ..... 239/413
3,801,020 A * 4/1974 Mocarski ..... 239/417.3
3,806,039 A * 4/1974 Mocarski ..... 239/417.3
4,411,388 A * 10/1983 Muck ..... 239/419.5
4,558,822 A * 12/1985 Nieuwkamp et al. ..... 239/403
4,592,509 A * 6/1986 Moss ..... 239/424
5,407,135 A * 4/1995 Jeffs ..... 239/288
7,340,846 B1 * 3/2008 Jou ..... 34/523

* cited by examiner

*Primary Examiner*—Christopher S Kim
(74) *Attorney, Agent, or Firm*—WPAT, P.C.; Anthony King

(57) ABSTRACT

A siphon type of drying gun includes an arc diverter disposed between an inner end surface in an accommodation space in a body of the gun and a flared hole. A rear cover having a flange is screwed into the body. An exhaustion gap is defined between the flange of the rear cover and the arc diverter. A front tapered hole in the rear cover corresponding to the arc diverter to guide the compressed air admitted into the exhaustion gap to flow by following the arc diverter and taking a turn into the flared hole so to produce siphon effects against ambient air to reduce noise level.

3 Claims, 6 Drawing Sheets

SIPHON DRYING GUN

BACKGROUND OF THE INVENTION (a) Field of the Invention

The present invention relates to a siphon type of drying gun, and more particularly, to one provided with an arc diverter to secure consistent jet of compressed air at higher flow rate to effectively reduce air consumption of the compressed air while lowering noise level of the drying gun in use.

(b) Description of the Prior Art

A siphon type of drying gun of the prior art is essentially applied to dry spray coverage of water solvable painting. As illustrated in FIGS. 5 and 6 of the accompanying drawings, a jet of compressed air is directly introduced into a passage 71 of a drying gun through an aerated slot 61 of an air inlet body 60 at an angle of thirty degrees (30°) and a lower pressure is created at the jet outlet of the aerated slot 61 to produce siphon effects against the ambient air of a cover 80; and the ambient air outside the cover 80 enters into the passage 71 to mix with the compressed air before being delivered out of an air outlet 72 to dry the painted object by heat. However, the prior art is found with the following shortcomings:

1. It creates noise at extremely high level since the jet of compressed air directly flows into the passage 71 through the aerated slot 61, the impact of jet diffuse around the inner wall of the passage 71.
2. Whereas multiple resting ends 62 are disposed to the air inlet body 60, multiple gaps as were nozzles are formed between the resting ends 62 and tapered holes 73 of the passage 71 in the head of the gun. Accordingly, disturbance created in an air chamber 74 when the compressed air gushes into the air chamber 74 through the gaps results in instable jet to increase noise level (75 dB is measured at where 1.5M away from the nozzle of the gun and decrease the air amount delivered due to compromised siphon effects.
3. The compressed air consumes too much air per minute to warrant additional burden of the air compressor and increased consumption of energy since the compressed air is directly ejected into the passage 71 through the aerated slot 61.

SUMMARY OF THE INVENTION

The primary purpose of the present invention is to provide a siphon type of drying gun to correct shortcomings of heavy consumption of air, inconsistent jet, and high noise level of the prior art.

To achieve the purpose, the present invention includes comprising a body, a rear cover, a diverter hood, and a handle; the body containing a flared hole in a front section thereof and an accommodation space in a rear section thereof, an inner threaded hole being disposed in the accommodation space to secure the rear cover, an arc diverter being disposed between the accommodation space and the flared hole, and a threaded hole being disposed at the bottom of the body to connect through the accommodation space with an airflow hole and to receive an air inlet pipe; the rear cover being provided with a threaded portion to be fastened to the rear section of the body, an annular groove to receive insertion of an O-ring to seal up the accommodation space in the rear section of the body, an annular air trough with a flange at the front of the annular air through, and front and rear tapered holes connecting through each other with the front tapered hole outwardly flared corresponding to the arc diverter and the rear tapered hole being provided with an accommodation hole and a strainer at a rear section thereof; the diverter hood received in the accommodation hole of the rear cover being disposed with an annular groove to receive insertion of an O-ring; and the handle covering up the air inlet pipe and connected to the bottom of the body with a lower end of the air inlet pipe exposed out of the bottom of the handle and secured with a nut and an air valve.

A starting point $S_1$ of the arc diverter in the present invention is at a level higher than a starting point $S_2$ of a camber of the taper angle of the front tapered hole. Accordingly, upon entering through an exhaust gap, the compressed air is first guided by the arc diverter disposed at a lower level to turn its direction into the flared hole by following the arc diverter; and the jet of the compressed air accelerates for being subject to the shape of the narrow exhaust gap so to produce even smaller low pressure siphon effects at where the jet takes its turn for inviting more air to be sucked in and reduce the air consumption volume. Therefore, energy consumption is comparatively reduced while the smooth flow of the compressed air helps effectively lower the noise level of the jet.

DETAILED DESCRIPTION OF THE PREFERRED EMBODIMENTS

Figure 1:
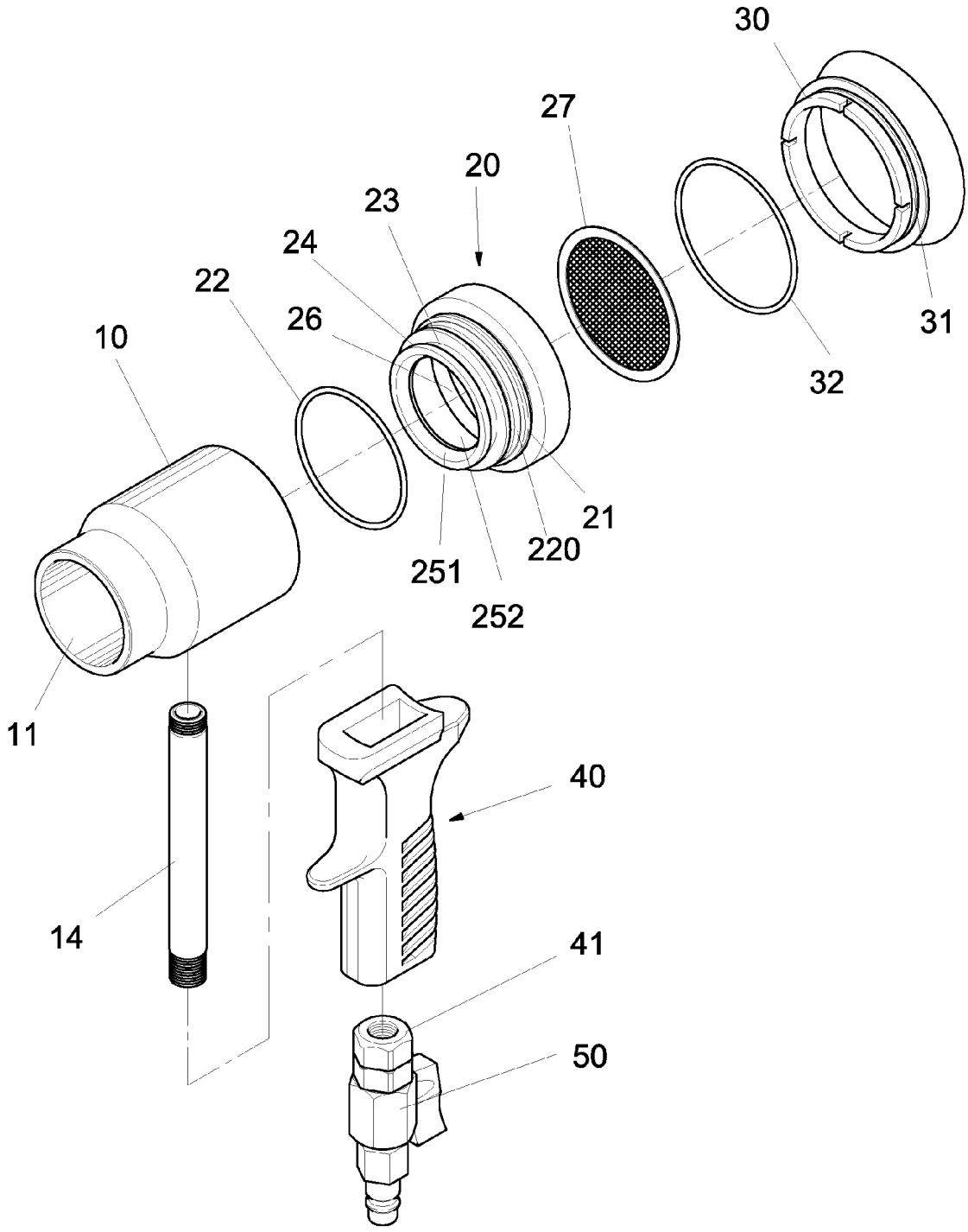
FIG. 1 is an exploded view of a preferred embodiment of the present invention.
Figure 2:
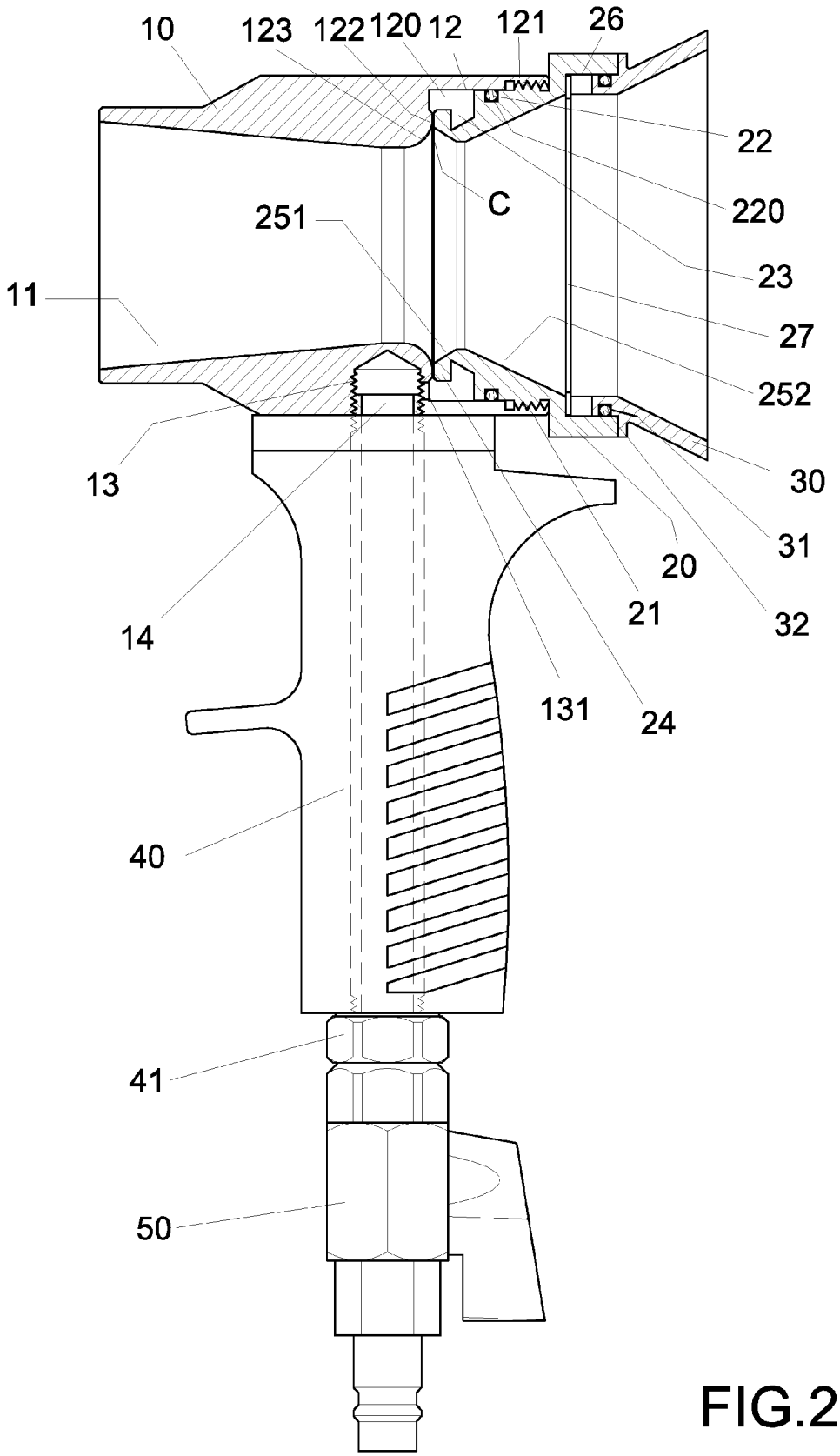
FIG. 2 is a sectional view of the preferred embodiment of the present invention as assembled.

Referring to FIGS. 1 and 2, a siphon type of drying gun of the present invention comprises a body 10, a rear cover 20, a diverter hood 30, and a handle 40.

The body 10 is disposed in its front end an outwardly flared hole 11, and in its rear section disposed with an accommodation space 12. An inner threaded hole 121 is disposed at a terminal of the accommodation space 12 to fasten the rear cover 20. An arc diverter 123 is disposed between an inner end surface 122 of the accommodation space 12 and the flared hole 11. A threaded hole 13 is disposed at the bottom of the body 10 connecting through the accommodation space 12 by means of an airflow hole 131 to fasten an air inlet pipe 14.

The rear cover 20 is provided with a threaded portion 21 to screw into the rear section of the body 10; an annular groove 220 to receive placement of an O-ring 22 so to seal the accommodation space 12 in the rear section of the body 10; an annular air trough 23 having its front end disposed with a flange 24. A front tapered hole 251 and a rear tapered hole 252 connecting through each other are disposed in the rear cover 20. The front tapered hole 251 corresponding to the arc diverter 123 is related to an outwardly flared tapered hole in a shorter range of travel, and the rear tapered hole 252 provided in a longer range of travel is disposed at its rear section an accommodation hole 26 to receive a strainer 27 and the diverter hood 30.

The diverter hood 30 is disposed with an annular groove 31 to receive an O-ring 32.

The handle 40 covers up the air inlet pipe 14 and is connected to the bottom of the body 10, and a lower end of the air inlet pipe 14 is exposed out of the bottom of the handle 40 and secured by means of a nut 41 and an air valve 50.

As illustrated in FIG. 2, a narrow exhaust gap C is maintained between a front edge of the rear cover 20 and the inner end surface 122 of the accommodation space 12 when the rear cover 20 is screwed into the accommodation space 12 in the rear section of the body 10. The gap C is in a width of 0.01~0.03 mm to admit the compressed air to enter into the body 10.

As illustrated in FIGS. 1 and 2, the flange 24 at the front of the rear cover 20 has an outer diameter slightly smaller than the inner diameter of the accommodation space 12 so that an annular air chamber 120 is defined among the accommodation space 12, the air trough 23, and the flange 24. The air chamber 120 receives the compressed air delivered by the air inlet pipe 14 through the airflow hole 131 for the compressed air to flow into the body 10 through the exhaust gap C.

Figure 3:
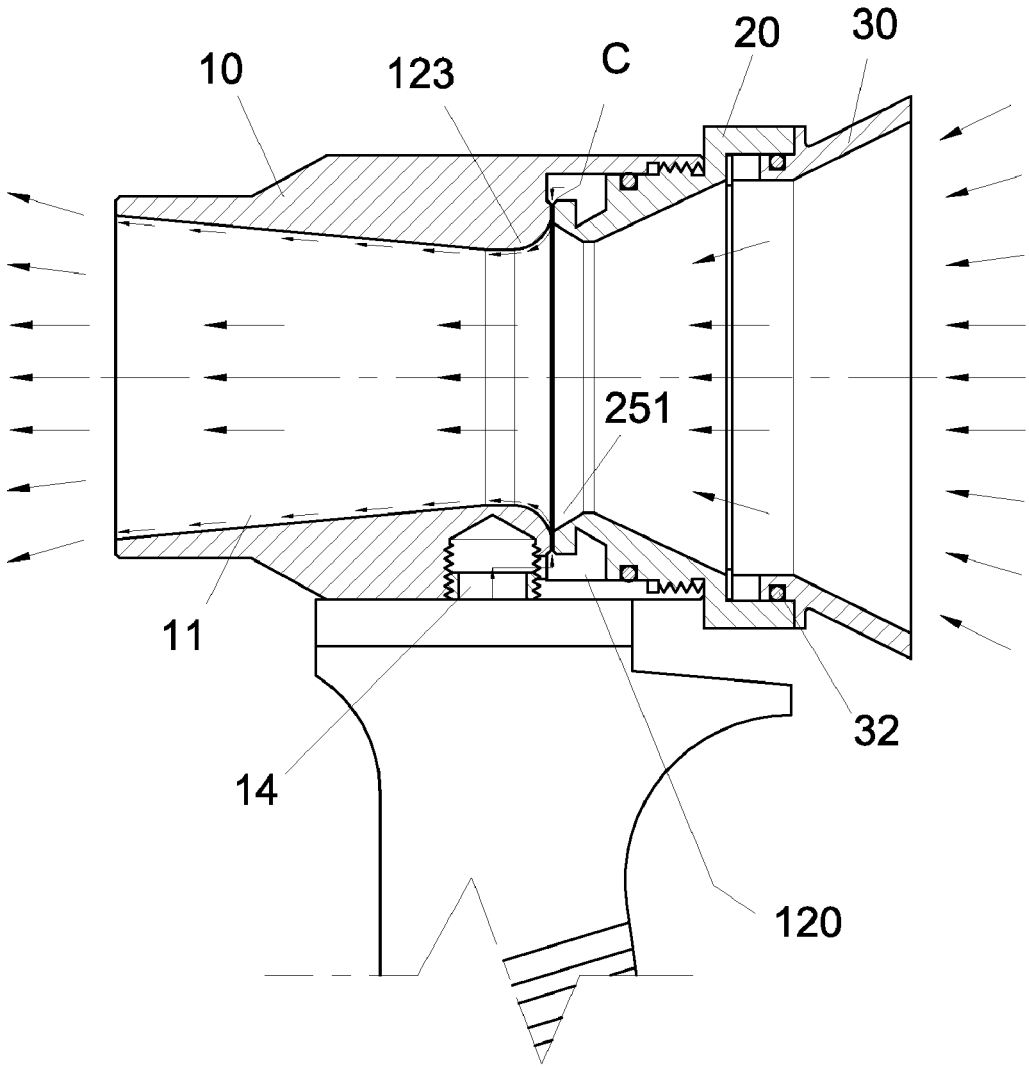
FIG. 3 is a schematic view showing flowing pattern of the compressed air and the ambient air sucked in due to siphon effects.
Figure 4:
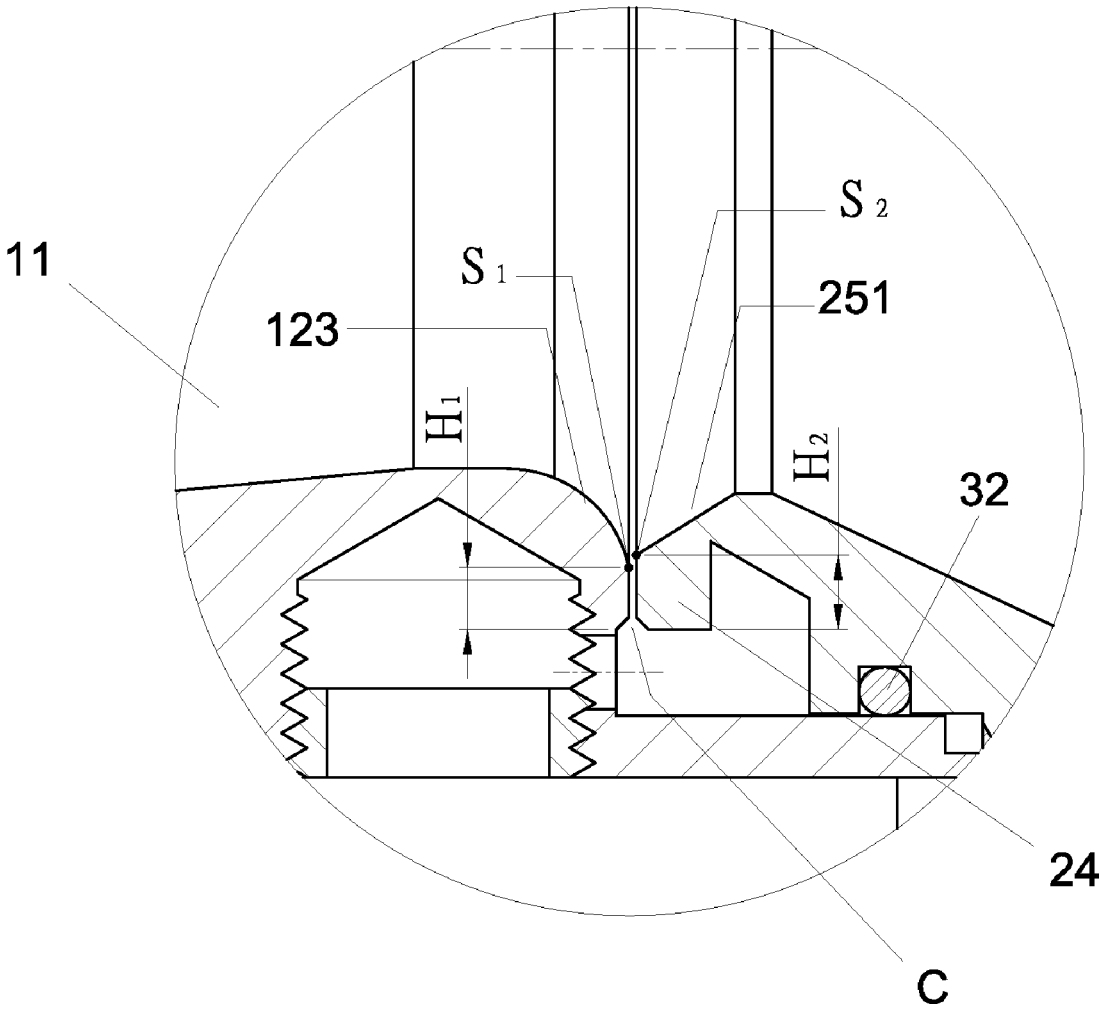
FIG. 4 is an enlarged view showing a local part of an exhaust gap created by mounting a rear cover to the gun.
Figure 5:
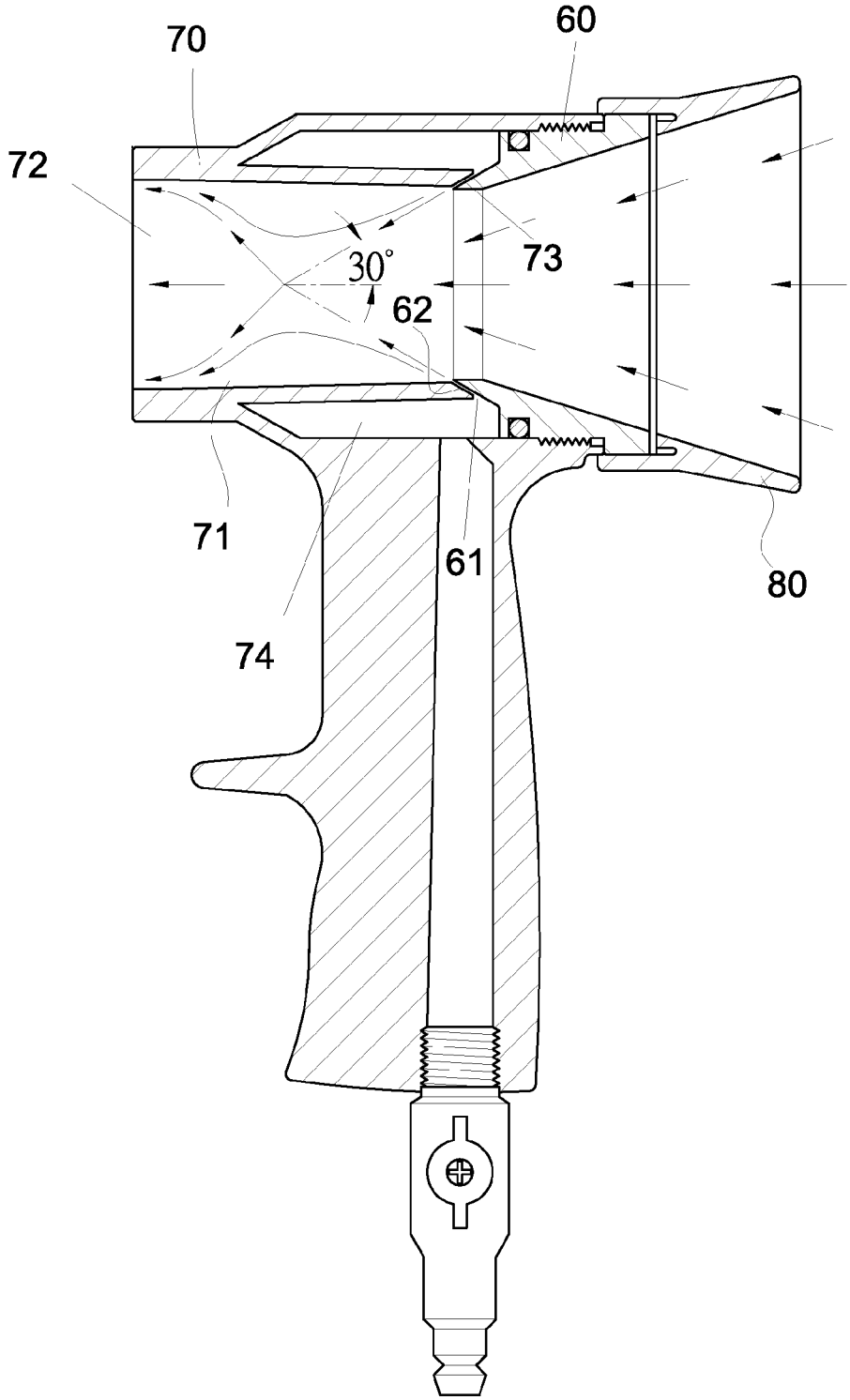
FIG.5 (PRIOR ART)
FIG. 5 is a schematic view showing a drying gun of the prior art.
Figure 6:
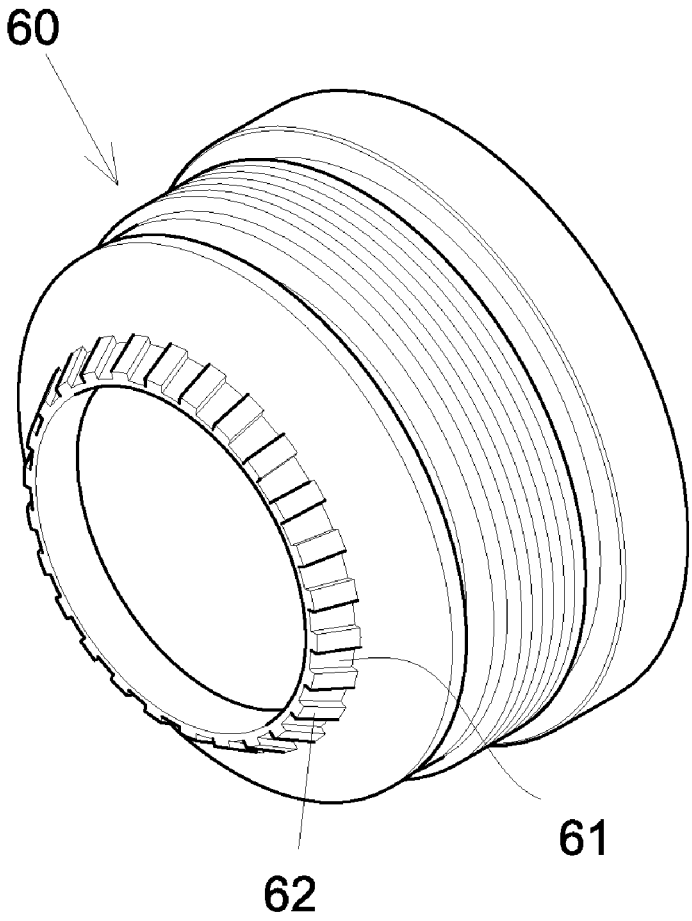
FIG.6 (PRIOR ART)
FIG. 6 is a perspective view of an air inlet body of the drying gun of the prior art.

Now referring to FIG. 3, while flowing into the air chamber 120 through the air inlet pipe 14, the compressed air follows the shape of the air chamber 120 to revolve around and fill up the entire air chamber 120 before being guided into the body 10 through the exhaust gap C. As illustrated in FIG. 4, a height $H_1$ of a starting point $S_1$ of the arc diverter 123 is at a level lower than a height $H_2$ of a starting point $S_2$ of a camber of the front tapered hole 251 with both heights H1 and H2 measured from a starting point of the exhaust gap C and the difference of the height between $H_1$ and $H_2$ is very small. Accordingly, upon entering through the exhaust gap C, the compressed air will be first guided by the arc diverter 123 at a lower level to follow the arc diverter 123 and take a turn into the flared hole 11; meanwhile, the compressed air will not flow backwards since there is no substantial object to guide the airflow in the camber of the front tapered hole 251 so that the compressed air exactly ejects in the direction by following the arc diverter 123. With the reduced area of the exhaust gap C, the flow rate of the compressor air accelerates according to the freewheeling principal, and the jet of the compressed air indicates a donut shape that flows as guided by the arc diverter 123 in the direction heading for the flared hole 11 and flows against the edges of the flared hole 11. With the accelerated flow rate at the arc diverter 123, the compressed air creates an even lower low pressure at the outlet of the jet according to Bernoulli's principal. The low pressure formed at the front tapered hole 251 produces siphon effects against the ambient air outside the diverter hood 30 at the rear end of the body 10. The ambient air at zero pressure (according to the pressure gage) enters into the rear cover 20 through the diverter hood 30 and further into the flared hole 11 where to be mixed with the compressed air; and the mixed air ejects from the outer end of the flared hole 11.

As illustrated in FIGS. 1, 2, and 3, the diverter hood 30 is inserted with the O-ring 32 made of rubber with a great friction resistance. The friction resistance keeps both the diverter hood 30 and the back cover 20 tightly secured to each other when the O-ring 32 and the diverter hood 30 are inserted into the accommodation hole 26 of the rear cover 20 to prevent the diverter hood 30 from loosening during the operation of the drying gun.

Whereas the compressed air flows by following the shape of the arc diverter 123 and takes a turn in the direction of the flared hole 11, it provides a very consistent jet with a noise level of 68 dB (measured at 1.5M away from the jet outlet) achieving a reduction of 7 dB from that of the prior art. Whereas the present invention provides a stronger siphon than the prior art, the ratio between the jet of the compressed air and the ambient air externally to the siphon is 1:4 with a specific value higher than 1:3 of the prior art. Increased air suction volume in turn reduces air consumption, On-Off operation frequency of an air compressor, and power consumption.

Accordingly, the present invention by producing consistent jet of the compressed air at high flow rate and low pressure as guided by a narrow exhaust gap and an arc diverter effectively reduces noise level, improves siphon effects, and increases air inlet volume to reduce air consumption of the compressed air and energy consumption.

What is claimed is:

1. A siphon drying gun, comprising a body, a rear cover, a diverter hood, and a handle;

the body containing a flared hole in a front section thereof and an accommodation space in a rear section thereof, an inner threaded hole being disposed in the accommodation space to secure the rear cover, an arc diverter being disposed between the accommodation space and the flared hole, and a threaded hole being disposed at the bottom of the body to connect through the accommodation space with an airflow hole and to receive an air inlet pipe;

the rear cover being provided with a threaded portion to be fastened to the rear section of the body, an annular groove to receive insertion of an O-ring to seal up the accommodation space in the rear section of the body, an annular air trough with a flange at the front of the annular air through, and front and rear tapered holes connecting through each other with the front tapered hole outwardly flared corresponding to the arc diverter and the rear tapered hole being provided with an accommodation hole and a strainer at a rear section thereof;

the diverter hood received in the accommodation hole of the rear cover being disposed with an annular groove to receive insertion of an O-ring; and the handle covering up the air inlet pipe and connected to the bottom of the body with a lower end of the air inlet pipe exposed out of the bottom of the handle and secured with a nut and an air valve.

2. The siphon drying gun as claimed in claim 1, wherein a narrow exhaust gap is defined between a front edge of the rear cover and an inner end surface of the accommodation space when the rear cover is fastened into the accommodation space in the rear section of the body.

3. The siphon drying gun as claimed in claim 1, wherein the arc diverter is disposed with a starting point; the front tapered hole is provided with a camber, and the starting point of the arc diverter is at a level higher than that of the camber of the front tapered hole.

* * * * *